US006554392B2

(12) United States Patent
Vega et al.

(10) Patent No.: US 6,554,392 B2
(45) Date of Patent: Apr. 29, 2003

(54) SYSTEM AND METHOD FOR MANAGING AN AUXILIARY SPITTOON IN A PRINTER

(75) Inventors: Ramon Vega, Sabadell Barcelona (ES); Xavier Girones, Mora la Nova Tarragona (ES); Xavier Bruch, Sant Cugat del Valles Barcelona (ES)

(73) Assignee: Hewlett-Packard Company, Fort Collins, CO (US)

( * ) Notice: Subject to any disclaimer, the term of this patent is extended or adjusted under 35 U.S.C. 154(b) by 56 days.

(21) Appl. No.: 09/932,974

(22) Filed: Aug. 21, 2001

(65) Prior Publication Data

US 2003/0038856 A1 Feb. 27, 2003

(51) Int. Cl.[7] ..... B41J 2/165
(52) U.S. Cl. ..... 347/23
(58) Field of Search ..... 347/23, 35

(56) References Cited

U.S. PATENT DOCUMENTS 6,293,646 B1 * 9/2001 Beachnau Hood et al. ... 347/23

* cited by examiner

*Primary Examiner*—Huan Tran

(57) ABSTRACT

A system and method for substantially optimizing print quality or throughput based upon user preferences through use of a left spittoon to perform servicing operations on the printhead of a printer. By virtue of the fact that print quality is inversely proportional to throughput, sacrificing one aspect yields an improvement in the other aspect. When a certain printmode is selected, e.g., draft, print, or the like, the throughput associated with printing according to the selected printmode may vary. Accordingly, a user may select to improve either the print quality, the throughput, or a combination thereof through implementation of the auxiliary spittoon to perform servicing operations on the printhead at various times during a printing operation.

30 Claims, 8 Drawing Sheets

SYSTEM AND METHOD FOR MANAGING AN AUXILIARY SPITTOON IN A PRINTER

FIELD OF THE INVENTION

This invention relates generally to inkjet printers. More specifically, the present invention relates, to a technique for managing the spitting of printhead nozzles in an auxiliary spittoon to maximize print quality or throughput based upon selected preferences.

BACKGROUND OF THE INVENTION

FIG. 1 illustrates a conventional large format inkjet printer 110 having a pair of legs 114, left and right sides 116, 118, and a cover 122. The printer 110 includes a carriage 100 supporting a plurality of printheads 102–108. The carriage 100 is coupled to a slide rod 124 with a coupling 125. As is generally known to those of ordinary skill in the art, during a printing operation, the carriage 100 travels along the slide rod 124 generally in a Y-axis direction 103 to make a printing pass, typically from the right side 118 to the left side 116 of the printer 110. In addition, as the carriage 100 travels along the Y-axis 103, certain of the printheads 102–108 drop ink onto a medium 130, e.g., paper, through a plurality of nozzles (not shown).

Typically, the medium 130 travels in an X-axis direction 101 at certain times during the printing operation. By virtue of performing a plurality of printing passes over the medium 130 by the carriage 100 in the above-described manner, an image, e.g, plot, text, and the like, may be printed onto the medium.

Also illustrated in FIG. 1 is a printer control panel 120 located on a right side 118 of the large format inkjet printer 110. The printer control panel 120 typically functions as an interface between a user and the printer 110 to enable certain printer operations to be set (e.g., medium advance, printmode, etc.). In addition to housing the printer control panel 120, the right side 18 of the printer 110 typically also houses printer components for performing printing operations (e.g., printer electronics, a service station for servicing operations on the printheads 102–108, etc.).

In performing printing operations with inkjet printers, it is generally known that the print quality and the throughput, i.e., amount of time required to print a plot, may be inversely related. That is, to increase throughput, the print quality is oftentimes sacrificed, or vice versa. To maintain a preferred level of print quality, servicing operations are typically performed on the printheads 102–108. In this respect, although not shown in FIG. 1, inkjet printers typically possess a service station located ("main spittoon") to perform the above-described servicing operations on the printheads 102–108. Additionally, although not shown in FIG. 1, large format inkjet printers have also been known to possess a second service station ("auxiliary spittoon").

The auxiliary spittoon may be provided to perform servicing operations on the printheads 102–108 in addition to those performed by the main spittoon. In addition, auxiliary spittoons may provide at least one specialized function, e.g., the application of primer on the printheads. Moreover, auxiliary spittoons may be provided in situations where the printer architecture calls for certain servicing operations to be performed in the auxiliary spittoons. For example, the auxiliary spittoon is oftentimes provided when the main spittoon has insufficient volume to contain ink spitted from the printheads. In addition, auxiliary spittoons may be utilized as part of a servicing routine before or after printing a page, during the printing process, and for specific servicing treatments, e.g., recoveries, cleaning, new printhead installation, etc.

There are generally two ways in which the nozzles of the printheads 102–108 may be "refreshed", i.e., cleaned. The nozzles may be refreshed by firing ink drops onto the medium 130, i.e., printing, or by spitting ink drops into the main spittoon. Thus, those nozzles of the printheads 102–108 that actively drop ink onto the medium typically are not required to spit into the main spittoon during various printing passes.

If it is preferred to increase throughput, the number of servicing operations performed on the printheads 102–108 may be reduced. In this respect, the length of time between the servicing operations may also be increased. One problem associated with increasing the length of time between servicing operations is that the properties of fired ink drops may deteriorate, thereby compromising the print quality. For example, ink in position to be fired from the nozzle may become dried and thus not fired through the nozzle. This effect is generally referred to as "decap" and typically occurs when a maximum amount of time a nozzle may be idle (i.e., not firing or spitting ink drops) before an ink drop may be ejected from that nozzle is exceeded. In addition, "slewing decap" generally refers to the maximum amount of time a nozzle may be idle during a pass across a medium. Moreover, because the nozzles are moving, the effects of "slewing decap" on the nozzles are typically worse than "decap". As a consequence, slewing decap times are generally shorter than decap times.

To relatively reduce the negative effects of decap, the main spittoons typically perform servicing operations on the printheads as well as capping the nozzles when the printheads are idle for a certain period of time. For example, the printheads typically spit ink into the main spittoons at various times during a printing operation to substantially prevent the occurrence of decap. Additionally, the main spittoons may also include a mechanism for wiping the nozzles of the printheads at various times to generally attempt to wipe off ink dried in the nozzles. Although the performance of the above-stated servicing operations on the printheads has been found to relatively increase the life of the printheads as well as the quality of the printed image, one disadvantage of performing a relatively large number of servicing operations is that the throughput may become compromised.

In performing bi-directional printing operations, especially when the printmode is set for the printheads to perform a left to right sweep, the inverse relationship between print quality and throughput is more evident. In one respect, because the main spittoon is typically not utilized to perform the servicing operations of the main spittoon, if the width of the plot is relatively small, i.e., letter size, A4, etc., the printheads must travel the full length of the printer for the servicing operations on the printheads to be performed, thus decreasing throughput. Otherwise, if the servicing operations are more sparsely performed, then the print quality may be adversely affected.

In those situations where throughput is not relatively important, e.g., during printhead replacement, printhead recovery, etc., the amount of time required to perform these functions is not necessarily critical and thus the amount of time required to use the main spittoon is not relatively detrimental. However, in those instances where throughput is a relatively important factor, and the auxiliary spittoon must be utilized, e.g., the geometry and configuration of the main spittoon is configured for normal spitting but is unable to contain the amount of ink necessary for the certain spitting operation, the carriage must move to the auxiliary spittoon to perform these functions, thereby adversely affecting throughput of the printing operation.

SUMMARY OF THE INVENTION

According to one aspect, the present invention pertains to a method for operating a printer having a main spittoon, an auxiliary spittoon, and a printhead. The printhead is operable to perform a uni-directional or bi-directional printing pass. In the method, a selected printmode is received and a decap time is determined in response to the received printmode. Nominal times to complete a uni-directional sweep and a bi-directional sweep are estimated and a last time the printhead was refreshed is determined. A servicing operation is performed in response to the last time the printhead was refreshed exceeding a predetermined value.

According to another aspect, the present invention pertains to an apparatus for operating a printer having a main spittoon, an auxiliary spittoon, and a printhead. The printhead is operable to perform a uni-directional or bi-directional printing pass. The apparatus includes a controller configured to receive a selected printmode and determine a decap time in response to the received printmode. In addition, the controller is further configured to estimate a nominal time to complete a uni-directional sweep and a bi-directional sweep. Furthermore, the controller is configured to determine a last time the printhead was refreshed.

According to yet another aspect, the present invention relates to a method for managing an auxiliary spittoon in a printer having a main spittoon and a printhead. The printhead is operable to perform a uni-directional or bi-directional printing pass. In the method, a selected printmode is received and a decap time is determined in response to the received printmode. Nominal times to complete a uni-directional sweep and a bi-directional sweep are estimated and a last time the printhead was refreshed is determined. In addition, it is determined whether the printing pass is a left to right sweep in response to the printmode being bi-directional and whether a single sweep time exceeds the decap time in response to the printing pass being a left to right sweep. Moreover, a spitting operation of the printhead is performed in the auxiliary spittoon in response to a sum of a current time, e.g., the time since the printer was activated, and the single sweep time minus a last time a spit on the fly was performed is greater than or equal to the decap time and a bi-directional printing pass with the printhead is performed.

According to still another aspect, the present invention relates to a computer readable storage medium on which is embedded one or more computer programs, where the one or more computer programs implement a method for operating a printer having a main spittoon, an auxiliary spittoon, and a printhead. The printhead is operable to perform a uni-directional or bi-directional printing pass. The one or more computer programs includes a set of instructions for receiving a selected printmode, determining a decap time in response to said received printmode, estimating a nominal time to complete a uni-directional sweep and a bi-directional sweep, determining a last time the printhead was refreshed, determining whether the printing pass is a left to right sweep in response to said printmode being bi directional, determining whether a uni-directional sweep time exceeds said decap time in response to the printing pass being a left to right sweep, performing a spitting operation of the printhead in the auxiliary spittoon in response to a sum of a current time, e.g., the time since the printer was activated, and the uni-directional sweep time minus a last time a spit on the fly was performed is greater than or equal to the decap time, and performing a bi-directional printing pass with the printhead.

BRIEF DESCRIPTION OF THE DRAWINGS

Features and advantages of the present invention will become apparent to those skilled in the art from the following description with reference to the drawings, in which.

DETAILED DESCRIPTION OF THE INVENTION

For simplicity and illustrative purposes, the principles of the present invention are described by referring mainly to an exemplary embodiment thereof, particularly with references to an example of a large format inkjet printer having a main and auxiliary service stations. However, one of ordinary skill in the art would readily recognize that the same principles are equally applicable to, and can be implemented in, any printer device that utilizes any number of service stations, and that any such variation would be within such modifications that do not depart from the true spirit and scope of the present invention.

According to the principles of the present invention, a method of optimizing print quality and/or throughput based upon user preferences is disclosed. By virtue of the fact that print quality is inversely proportional to throughput, sacrificing one aspect yields an improvement in the other aspect. Thus, when a certain printmode is selected, e.g., draft, print, or the like, the throughput associated with printing according to the selected printmode may vary. Accordingly, a user may select to improve either the print quality, the throughput, or a combination thereof.

Generally speaking, the method of the present invention pertains to use of the auxiliary spittoon as a device for optimizing print quality and/or throughput based upon selected user preferences. For example, a user may select the highest quality output, thus relatively decreasing throughput. In addition, a user may select a bi-directional printmode, which may also relatively increase throughput. As will become clearer from a reading of the present disclosure, by virtue of certain aspects of the present invention, a user may substantially customize the printing operation by selecting from a variety of preferences.

Figure 2:
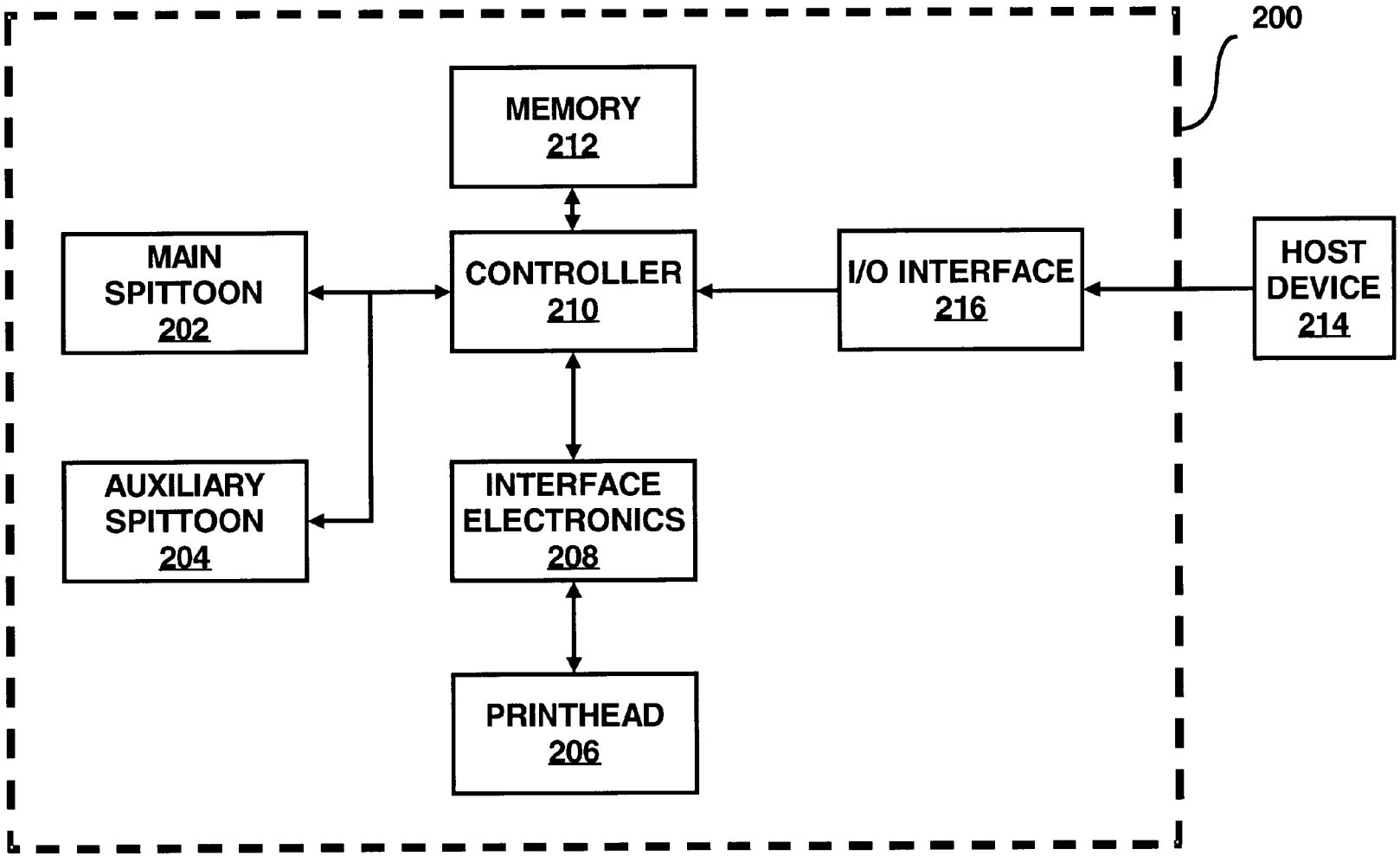
FIG. 2 illustrates an exemplary block diagram of a printer in accordance with the principles of the present invention.

Referring to FIG. 2, there is illustrated an exemplary block diagram of a printer 200 in accordance with the principles of the present invention. The following description of the block diagram illustrates one manner in which a printer 200 having a main spittoon 202 and an auxiliary spittoon 204 may be operated in accordance with the principles of the present invention. In this respect, it is to be understood that the following description of the block diagram is but one manner of a variety of different manners in which such a printer may be operated.

Generally speaking, the printer 200 includes a printhead 206, although a plurality of printheads may be included. The description of one printhead 206 in the present disclosure is for purposes of simplicity and is not meant as a limitation. In this regard, the printer 200 may include any reasonably suitable number of printheads, e.g., two, four, six, and the like, configured to operate in the manner described hereinbelow with respect to the printhead 206. In addition, the printer 200 is illustrated and described in terms of a large format inkjet printer; however, it should be understood and readily apparent to those skilled in the art that the auxiliary spittoon management technique disclosed herein may be implemented in any reasonably suitable type of printer without departing from the scope or spirit of the present invention.

The printhead 206 may be configured to repeatedly pass across a medium in individual, horizontal swaths or passes during a printing operation to print a particular image (e.g., picture, text, diagrams, etc.) onto the medium. In addition, the printhead 206 may be configured to contain a plurality of nozzles (not shown) operable to be implemented during each pass to apply an ink pattern onto the medium and thus print the particular image. In this regard, the printhead 206 may comprise a conventional thermal inkjet printhead or a conventional piezoelectric printhead, both of which are generally known to those skilled in the art.

The printer 200 may also include interface electronics 208. The interface electronics 208 may be configured to provide an interface between a controller 210 of the printer 200 and the components for moving the printhead 206, e.g., a carriage, belt and pulley system (not shown), etc. The interface electronics 210 may include, for example, circuits for moving the printhead 206, moving the medium, firing individual resistors or piezoelectric elements in the nozzles of the printhead, and the like.

The controller 210 may be configured to provide control logic for the printer 200, which provides the functionality for the printer. In this respect, the controller 210 may possess a microprocessor, a micro-controller, an application specific integrated circuit, and the like. The controller 210 may be interfaced with a memory 212 configured to provide storage of a computer software that provides the functionality of the printer 200 and may be executed by the controller. The memory 212 may also be configured to provide a temporary storage area for data/file received by the printer 200 from a host device 214, such as a computer, server, workstation, and the like. The memory 212 may be implemented as a combination of volatile and non-volatile memory, such as dynamic random access memory ("RAM"), EEPROM, flash memory, and the like. It is also within the purview of the present invention that the memory 212 may be included in the host device 214.

The controller 210 may further be interfaced with an I/O interface 216 configured to provide a communication channel between a host device 214 and the printer 200. The I/O interface 216 may conform to protocols such as RS-232, parallel, small computer system interface, universal serial bus, etc. In addition, the controller 210 may be interfaced with the main spittoon 202 and the auxiliary spittoon 204, e.g., spittoons of the main and auxiliary service stations.

Figure 3:
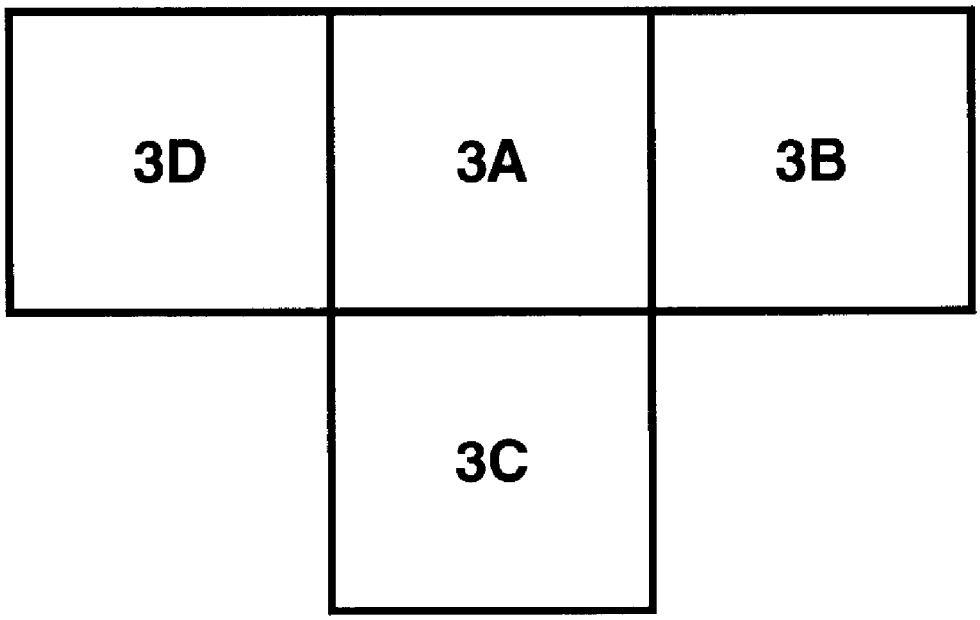
FIG. 3 is a key to FIGS. 3A–3D.

Referring to FIG. 3, there is illustrated a key for FIGS. 3A–3D, which together, illustrate exemplary flow diagrams 300 of a manner in which the principles of the present invention may be practiced. The following description of the flow diagram 300 is made with reference to the block diagram illustrated in FIG. 2, and thus makes reference to the elements illustrated therein. It is to be understood that the steps illustrated in the flow diagram 300 may be contained as a subroutine in any desired computer accessible medium. In addition, the flow diagram 300 may be performed by a computer program, which can exist in a variety of forms both active and inactive. For example, they can exist as software program(s) comprised of program instructions in source code, object code, executable code or other formats. Any of the above can be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), and magnetic or optical disks or tapes. Exemplary computer readable signals, whether modulated using a carrier or not, are signals that a computer system hosting or running the computer program can be configured to access, including signals downloaded through the Internet or other networks. Concrete examples of the foregoing include distribution of the programs on a CD ROM or via Internet download. In a sense, the Internet itself, as an abstract entity, is a computer readable medium. The same is true of computer networks in general. Although particular reference is made in the following description of FIG. 2 to the controller 210 as performing certain printer functions, it is to be understood that those functions may be performed by any electronic device capable of executing the above-described functions.

Figure 3A:
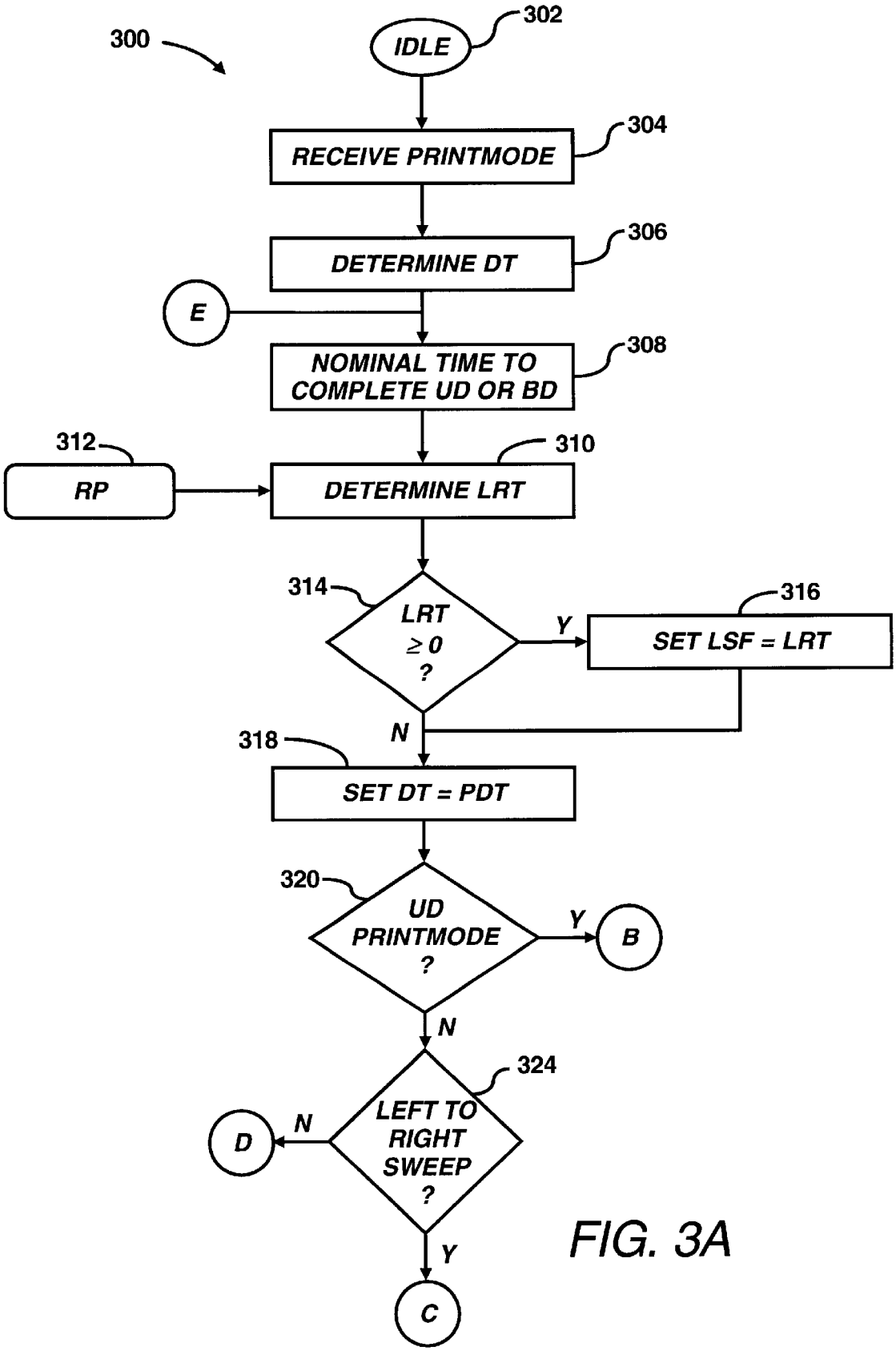
FIGS. 3A–3D, together, illustrate exemplary flow diagrams of a manner in which the principles of the present invention may be practiced.

With reference to FIG. 3A, in step 302, the printer 200 may be in an idle state prior to receiving a plot file from a host device 214. The idle state may refer to the state in which the printhead 206 is capped to prevent the ink contained in the nozzles from drying out. When the printer exits the idle state, the printhead 206 is uncapped and depending upon the amount of time the printhead was capped, a servicing operation may be performed. The servicing operation typically includes the spitting of the nozzles into a spittoon as well as at least one wiping operation of the nozzles to ensure their proper functionality. The level, e.g., number of spits, wipes, etc., of servicing may be dependent upon the amount of the time the printhead 206 is idle prior to waking.

Figure 1:
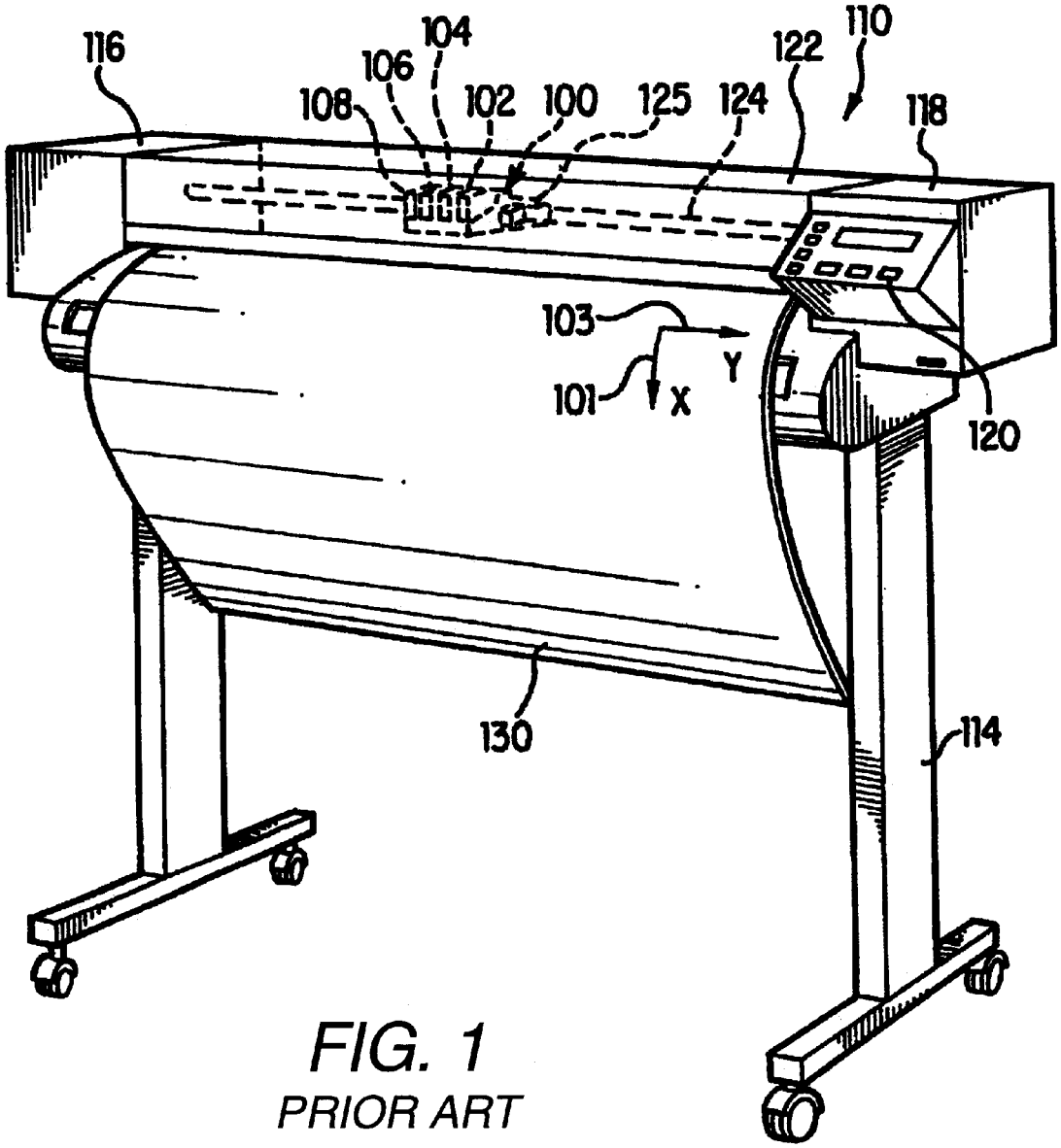
FIG. 1 PRIOR ART
FIG. 1 is a perspective view of a conventional large format inkjet printer.

In step 304, the printer 200 may receive printmode instructions from the host device 214 as an interface to a user, or the printer may receive printmode instructions directly through a printer control panel 120 (FIG. 1). As an alternative to the order of steps 302 and 304, the printer 200 may receive the printmode instructions prior to receipt of the plot file. The printmode instructions may include receipt of instructions from a user regarding a desired quality and/or throughput of the printing operation. In this respect, the printmode instructions may include receipt of instructions regarding the desired printing direction characteristics. That is, whether the printhead 206 is to travel uni-directionally ("UD") or bi-directionally ("BD").

In step 306, depending upon the received printmode instructions, the controller 210 determines the decap threshold ("DT"). The DT refers to the maximum amount of time that a nozzle of a printhead may remain idle, i.e., not printing or spitting ink, before risking deterioration of print quality below a predetermined standard. The DT may be supplied by a printhead manufacturer or it may be determined through testing of the printheads. The DT may also vary according to the selected printmode. In one respect, the DT may be relatively longer for a lower quality printing operation than a higher quality printing operation. The DT may be based upon a decap time, e.g., time out of cap, or it may be based upon slewing decap, e.g., time during travel across the medium.

In step 308, the nominal time to complete a printing pass for both UD printing and BD printing are calculated. The data received in performing steps 304–308 may also be stored in the memory 212 for later retrieval and implementation. Because the width of the plots to be printed during a printing operation may vary, the controller 210 may perform a "logic seeking" function at step 308. That is, the controller 210 may determine the width of the upcoming plot, e.g., the length of printhead travel along the medium during the printing of the upcoming plot. This information may then be utilized by the controller 210 to determine when the printhead 206 may need to undergo a servicing operation. Thus, the calculations performed by the controller 210 to determine the time the printhead 206 may need to undergo a servicing operation may depend from the actual pass width of the upcoming plot and not from the entire width of the current plot. In this respect, the time the printhead 206 may require servicing may be determined with relatively greater accuracy.

Figure 4A:
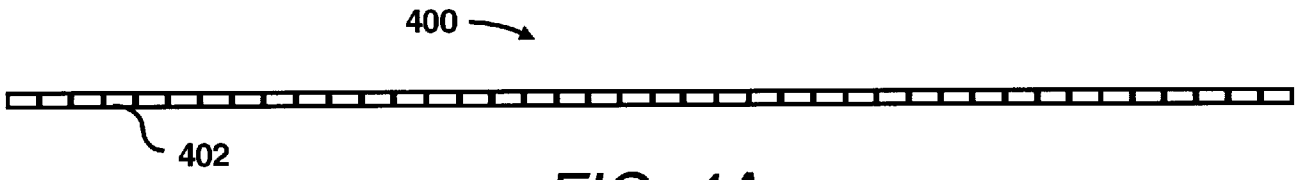
FIGS. 4A–4F, together, illustrate an exemplary manner in which a last refresh time may be determined.
Figure 4B:
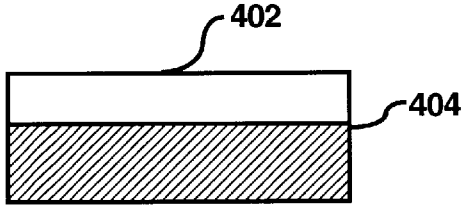
Figure 4C:
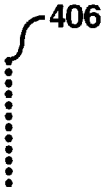

In step 310, the last refresh time ("LRT") for the printhead 206 is determined. Depending on the plot to be printed, some of the nozzles may fire ink onto the medium, whereas, certain others may not fire any ink until some passes later. Generally speaking, the LRT is the current time minus the last time the nozzles of the printhead 206 were refreshed. The LRT may be based upon the last time the nozzles of the printhead 206 fired drops of ink onto the medium (otherwise known as refreshed by printing ("RP")). In step 312, a log may be maintained storing data in the memory 212 on the last time RP occurred for the nozzles. The logged data may then be transferred to the controller 210 for an assignment of the LRT based upon the RP. Additionally, the LRT may be based upon the last time the nozzles were refreshed by spitting on the fly ("RS"). RS generally refers to the spitting of ink from the nozzles during a printing pass. In this respect, RS may occur as an extension of a printing pass, generally while the printheads 206 are decelerating or accelerating between passes. Otherwise, the LRT may be based upon a logged time from when the nozzles were decapped and spitted prior to performing a printing pass In step 314, the controller 210 determines whether the nozzles of the printhead 206 have been refreshed by printing (RP). That is, whether the last refresh time ("LRT") is greater than or equal to zero. As illustrated in FIGS. 4A–4F, the LRT may be calculated based upon the percentage of nozzles that have been fired and the amount of ink fired by those nozzles. Referring first to FIG. 4A, a swath 400 is illustrated as including a plurality of cells 402. In FIG. 4B, an enlarged view of one of the cells 402 is illustrated as well as the level of ink 404 (cross-hatched region) fired onto the cell. The level of ink 404 fired into each cell 402 may vary along the swath 400. FIG. 4C illustrates a row of nozzles 406 that may have been utilized in firing the 30 ink 404 onto the cell 402.

Figure 4D:
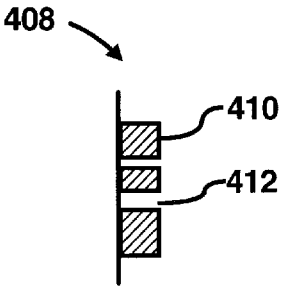

FIG. 4D illustrates a histogram 408 showing a calculated amount of ink fired each of the utilized nozzles 406. In addition, in the histogram 408, the shaded regions 410 indicate which of the nozzles 406 were fired and the empty regions 412 indicate those nozzles which have not been utilized to fire ink in the cell 402. Because the number of times and the amount of ink fired by each of the utilized nozzles 406 may not be measured, an average usage is depicted in the histogram 408. Thus, because an estimated total amount of ink fired into cell 402 may be calculated, that amount of ink may be averaged out among those nozzles that have been utilized. In this respect, although FIGS. 4B and 4D are not drawn to scale, the amount of ink 404 fired in cell 402 is equivalent to the area of the cross-hatched regions 410.

Figure 4E:
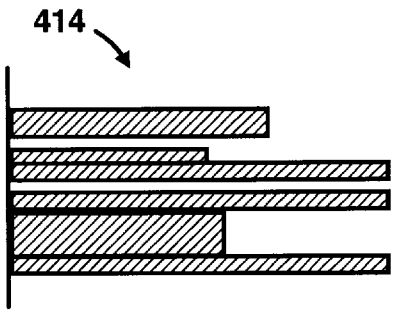
Figure 4F:
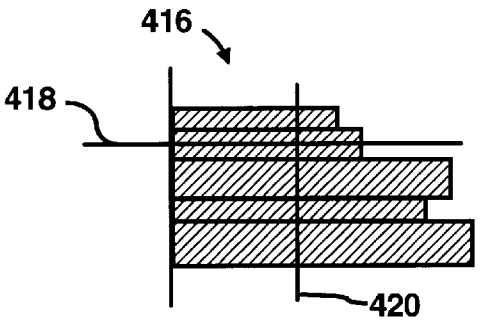

FIG. 4E illustrates a histogram 414 that shows the sum of the nozzle usages calculated in the histogram 408 of FIG. 4D for a certain number of cells 402. FIG. 4F illustrates a histogram 416 depicting a sorted calculation of nozzle usage for each cell 402. The histogram 416 may be implemented to determine whether a certain predetermined minimum threshold percentage of nozzles 418 has fired a predetermined minimum threshold amount of ink 420. The above-stated predetermined minimum values may be selected according to a received printmode. In one respect, the predetermined minimum values may be relatively higher for a lower quality printing operation than a higher quality printing operation.

The LRT may be determined by considering whether, in the histogram 416, the percentage of nozzles fired exceeds a predetermined threshold 418 and the predetermined minimum amount of ink 420. In this regard, if the histogram 416 indicates that both of the above are true, then the LRT, in step 314 may be considered as being greater than or equal to 0. If the histogram 416 indicates that both of the above are not true, the LRT may be considered as being less than 0. In addition, because the individual cells 402 implemented to determine whether the nozzles have been refreshed, it may be possible to determine that certain of the nozzles have been refreshed at a position during the printing of the swath. In this respect, for example, it may be possible to determine that a printhead may require a servicing operation at some time during the printing of a subsequent swath. In addition to the above-described manners in which the LRT may be determined, the LRT may also be set such that a negative number may indicate that the printheads have not been refreshed and that a positive number is an indication that the refresh threshold has been satisfied. In this respect, the LRT may initially be set prior to a printing pass to a negative value with drops fired from the nozzles increasing that value. At the end of the printing pass, if the LRT is a negative number, then in step 314, LRT is less than zero and if the LRT is a positive number or equal to zero, then step 316 is performed.

In step 318, the DT is set to equal the printmode decap time ("PDT"). The PDT refers to the length of time a nozzle of a printhead may be idle for a given printmode. In this respect, the PDT may vary according to the received printmode instructions. That is, the PDT may be substantially longer for a print operation that is set for "draft" printing, whereas, the PDT may be substantially shorter for a higher quality printing operation. More particularly, the PDT may be tested to determine the degree to which increased amounts of time adversely affect the print quality. In this respect, the amount of idle time and the effects on print quality may be placed in a chart (not shown) which may be referenced when a selected printmode is received by the controller 210 to thereby optimize the printing operation based upon the user's selected expectations.

Figure 3B:
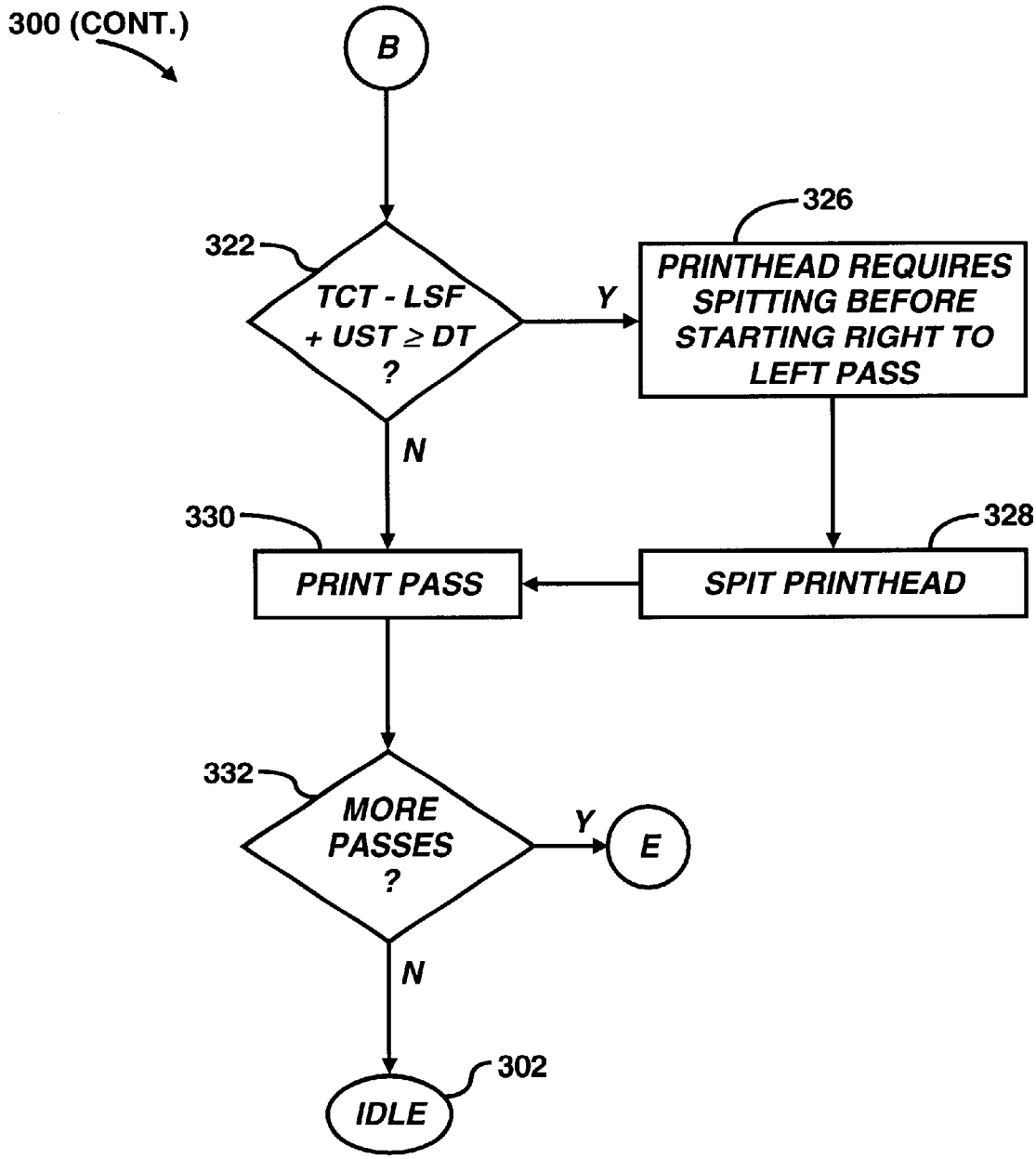

In step 320, if the selected printmode is UD, the controller 210 may determine whether the printhead 206 is capable of completing a UD sweep without suffering from some of the problems associated with being decapped for a predetermined period of time at step 322 (FIG. 3B). In this respect, the controller 210 may determine whether the current time ("TCT"), e.g., the time since the printer was activated, minus the last spit on the fly ("LSF") plus the UD sweep time ("UST") is greater than or equal to the decap time ("DT"). If this condition is true, the printhead 206 is marked as requiring spitting prior to starting the right to left pass, as indicated at step 326. At step 328, the printhead 206 may perform a spitting operation into the main spittoon prior to starting the right to left printing pass at step 330.

If the controller 210 determines that the printhead 206 is capable of performing the UD sweep without suffering from the above-described decap problems, a spitting operation is not performed prior to performing the right to left printing pass at step 330. Upon completing the UD printing pass, the printhead 206 returns to the right side of the printer 200 to await instructions to perform another printing pass. At step 332, if additional passes are required, the process starting at step 308 (FIG. 3A) may be repeated. Otherwise, the controller 210 may operate the printer 200 to go into an idle mode at step 302, i.e., stand-by mode, shut down, and the like, until further instructions to perform another printing pass are received.

Figure 3C:
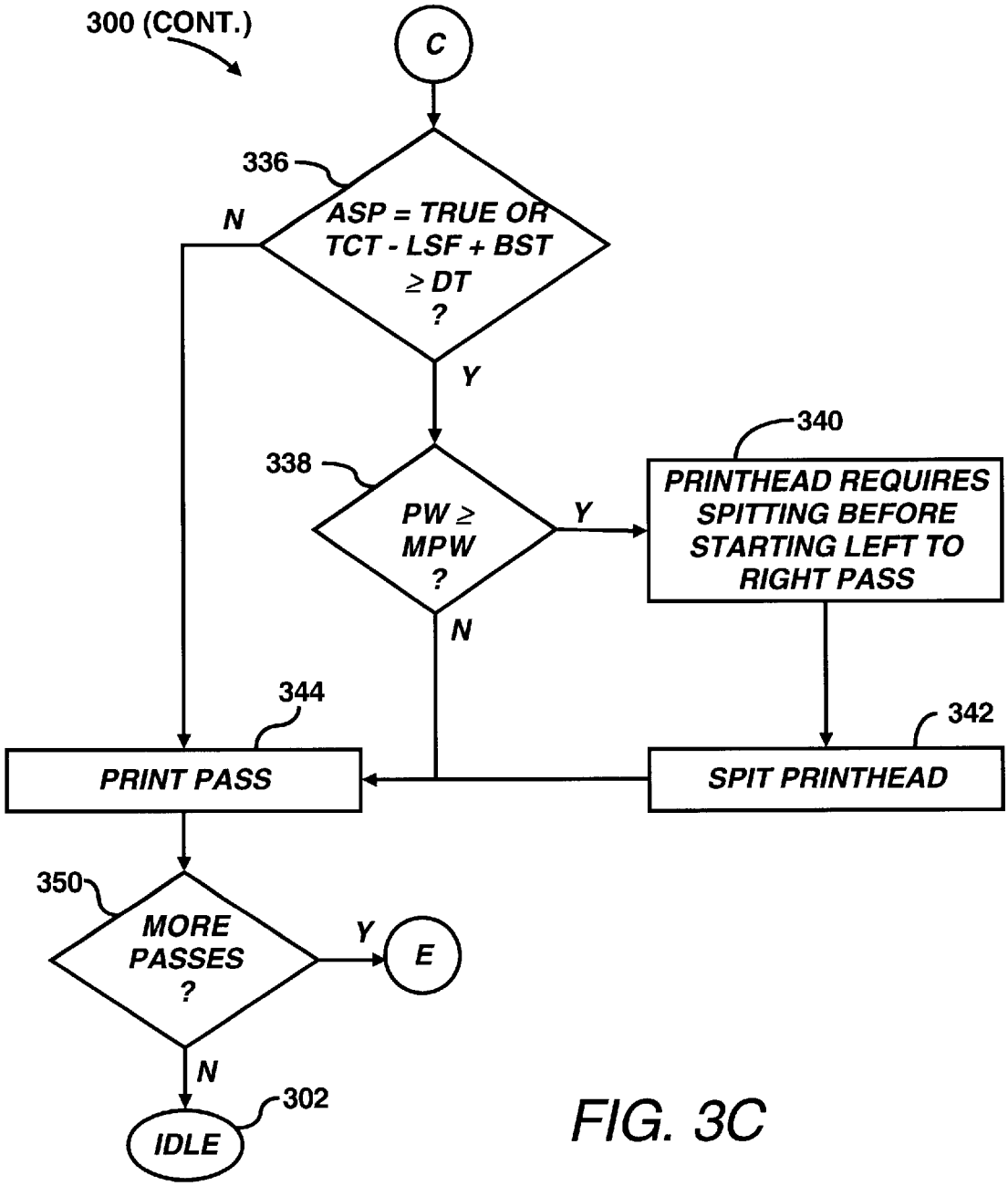

Referring back to FIG. 3A, if the selected printmode is BD, i.e., at step 320, the selected printmode is not UD, the controller 210 may determine whether the selected printmode is a left to right sweep at step 324. In FIG. 3C, at step 336, the controller 210 may determine whether there is a flag indicating that a spit operation to be performed at the auxiliary spittoon is pending ("ASP"=true) or whether the printhead 206 is incapable of completing a BD sweep without suffering from problems associated with being decapped for a predetermined period of time. In this respect, the controller 210 determines whether the current time ("TCT") minus the last spit on the fly ("LSF") plus the single sweep time ("SST"), i.e., the amount of time required for the printhead to move from one side of the printer to the other, is greater than or equal to the decap time ("DT"). If this condition is true, the controller 210 may determine whether the width of the plot to be printed ("PW") during the printing pass exceeds a minimum pass width threshold "(MPW") at step 338. The MPW may be determined based upon a plurality of factors. These factors, for example, may include a tradeoff between print quality and throughput as determined by a focus group. If this condition is also true, the printhead 206 is marked as requiring spitting prior to starting the right to left pass, as indicated at step 340. At step 342, the printhead 206 may perform a spitting operation into the auxiliary spittoon prior to starting the left to right printing pass at step 344.

If the condition set forth in step 338 is not satisfied, i.e., PW is less than MPW, the pass may be printed, however, the print quality ("PQ") of the pass may not be guaranteed.

Referring back to step 336, if there is no auxiliary spit pending or there may be sufficient time to complete the BD sweep without suffering from problems associated with being decapped for a predetermined period of time, the controller 210 may control the printhead 206 to perform the BD printing pass at step 344. Upon completing the BD printing pass, the printhead 206 returns to the left side of the printer 200 to await instructions to perform of another printing pass. At step 350, if additional passes are required, the process starting at step 308 (FIG. 3A) may be repeated. Otherwise, the controller 210 may operate the printer 200 to go into an idle mode at step 302, i.e., stand-by mode shut down, and the like, until another instruction to perform a printing pass is received.

Figure 3D:
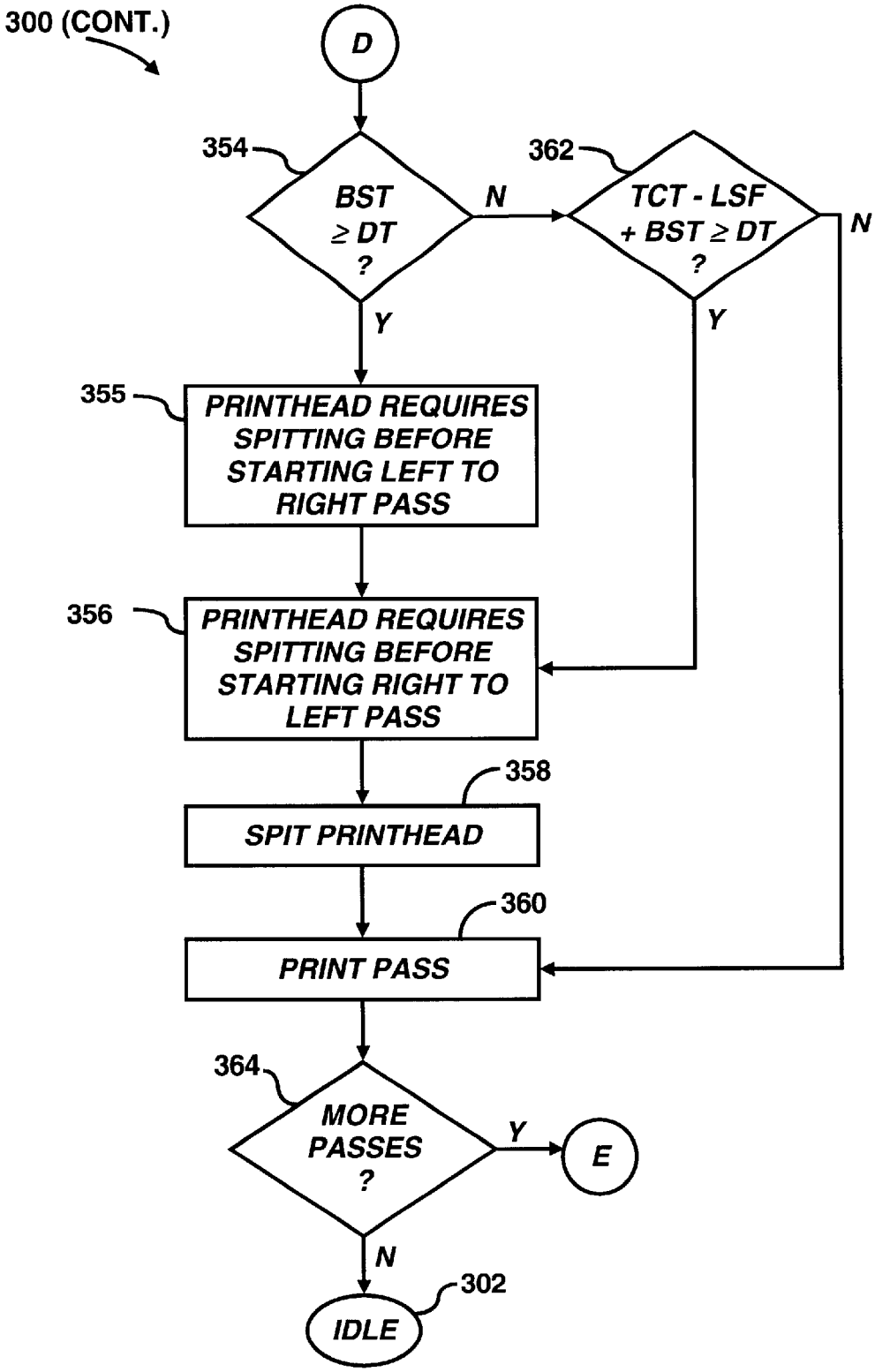

Referring again to FIG. 3A, at step 324, if the BD printmode is not set to perform a left to right sweep, i.e., the printmode is set to perform a right to left sweep, the controller 210 may determine whether the time required to complete a BD sweep ("BST") is greater than or equal to the decap time ("DT") at step 354 (FIG. 3D). If this condition is true, the printhead 206 may be marked as requiring spitting prior to starting the right to left printing pass, as indicated at step 356. At step 358, the printhead 206 may perform a spitting operation into the main spittoon prior to starting the right to left printing pass at step 360.

If, at step 354, the controller 210 determines that the printhead 206 is capable of performing the BD sweep without suffering from the above-described decap problems, the controller may determine whether the current time ("TCT") minus the last spit on the fly ("LSF") plus the single sweep time ("SST") is greater than or equal to the decap time ("DT"). If this condition is true, the printhead 206 may be marked as requiring spitting prior to starting the right to left pass, as indicated at step 356. In the manner described hereinabove, at step 358, the printhead 206 marked for spitting may perform a spitting operation into the main spittoon prior to starting the right to left printing pass at step 360. Otherwise, if TCT−LSF+BST is <DT, the controller 210 may operate to control the printhead 206 to print the BD pass at step 360.

If, at step 354, the controller 210 determines that the printhead 206 is incapable of performing the BD sweep without suffering from the above-described decap problems, i.e., BST is <DT, the printhead may be marked as requiring spitting in the auxiliary spittoon prior to performing the left to right pass at step 355. In this instance, it may be necessary to spit the printhead 206 in both the main 202 and auxiliary 204 spittoons of the printer. In addition, the controller 210 may operate to cause the printhead 206 to stop over the auxiliary spittoon 204 at the end of the right to left pass instead of over a nominal turnaround position, to reduce the amount of time necessary to perform the spitting operation in the auxiliary spittoon.

Upon completing the BD printing pass, the printhead 206 may return to the right side of the printer 200 to await performance of another printing pass. At step 364, if additional passes are required, the process starting at step 308 (FIG. 3A) may be repeated. Otherwise, the controller 210 may operate the printer 200 to go into an idle mode at step 302, i.e., stand-by mode, shut down, and the like, until another instruction to perform a printing pass is received.

In addition to the above-described times and/or events which may require the printhead 206 to be spitted in either the main or auxiliary spittoons 202, 204, the printhead may also undergo a "control spitting". Control spitting generally refers to a spitting operation to clear out the nozzles to a greater extent than is possible during spit on the fly and refresh by printing. In one respect, control spitting may be required because the spitting of a few drops of ink during a printing operation or during a spit on the fly operation may be inadequate to substantially clear out a relatively damaged nozzle. Control spitting generally involves maintaining the printhead 206 over a spittoon to perform a higher number of spits from the nozzles than during flying spits. In this regard, control spitting is typically performed to generally reset the printhead 206 after the nozzles have been out of cap for a certain period of time. Control spitting may be set to occur at various times during the printing operation an may be set to recur at periodic rates, e.g., every 10 minutes, every 20 minutes, etc. In addition, the control spitting may be set to occur in either the main spittoon 202 or the auxiliary spittoon 204, depending upon the proximity of the printhead 206 to each of the spittoons. For example, if the printhead 206 is closer to the auxiliary spittoon 204 when the time for the control spitting arises, the printhead may perform the control spitting in the auxiliary spittoon. By virtue of the potential reduction in travel time for the printhead 206, the amount of time required to perform the control spitting may be substantially reduced.

In accordance with the principles of the present invention, the auxiliary spittoon may be utilized to substantially optimize print quality or throughput. Accordingly, by implementing the auxiliary spittoon in certain situations, the print quality and/or throughput may be modified to substantially meet a user's expectations.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for operating a printer having a main spittoon, an auxiliary spittoon, and printhead, said printhead being operable to perform a uni-directional or bi-directional printing pass, said method comprising:

receiving a selected printmode;

determining a decap time in response to said received printmode;

estimating a nominal time to complete a uni-directional sweep and a bi-directional sweep;

determining a last time said printhead was refreshed; and performing a servicing operation on said printhead in response to said last time said printhead was refreshed exceeding a predetermined value.

2. The method according to claim 1, wherein said step of determining a last time said printhead was refreshed comprises:

determining which nozzles of said printhead were utilized in firing ink onto each cell of a prior printing pass;

determining a total amount of ink fired into each said cell by said utilized nozzles;

approximating an amount of ink fired by each of said utilized nozzles based on said total amount of ink fired into each cell;

detecting a time and cell in which the number of utilized nozzles is equal to or exceeds a predetermined threshold percentage of total nozzles in said printhead and in which the amount of ink fired into said cell is equal to or exceeds a predetermined threshold amount of ink; and setting said last time said printhead was refreshed in accordance with said detected time and cell.

3. The method according to claim 1, wherein said step of estimating a nominal time to complete a uni-directional sweep and a bi-directional sweep comprises determining the width of an upcoming plot.

4. The method according to claim 1, further comprising:

determining whether said printmode is uni-directional; and determining whether a uni-directional sweep time exceeds said decap time in response to said printmode being uni-directional.

5. The method according to claim 4, further comprising:

determining whether a sum of a current time and the uni-directional sweep time minus a last time a spit on the fly was performed is greater than or equal to said decap time;

performing a spitting operation of said printhead said main spittoon in response to said sum of said current time and said uni-directional sweep time minus a last time a spit on the fly was performed being greater than or equal to said decap time; and performing a uni-directional printing pass with said printhead.

6. The method according to claim 4, further comprising:

performing a spitting operation of said printhead in said main spittoon in response to said uni-directional sweep time exceeding said decap time; and performing a uni-directional printing pass with said printhead.

7. The method according to claim 1, further comprising:

determining whether said printing pass is a left to right sweep in response to said printmode being bi-directional.

8. The method according to claim 7, further comprising:

determining whether a single sweep time exceeds said decap time in response to said printing pass being a left to right sweep.

9. The method according to claim 8, further comprising:

determining whether a sum of a current time and the uni-directional sweep time minus a last time a spit on the fly was performed is greater than or equal to said decap time.

10. The method according to claim 9, further comprising:

determining whether a pass width of said printing pass is greater than or equal to a predetermined minimum pass width threshold in response to said sum of said current time and the uni-directional sweep time minus said last time a spit on the fly was performed being greater than or equal to said decap time;

performing a spitting operation in said auxiliary spittoon in response to said pass width of said printing pass being greater than or equal to said predetermined minimum pass width threshold; and performing a bi-directional printing pass with said printhead.

11. The method according to claim 7, further, comprising:

determining whether a bi-directional sweep time exceeds said decap time in response to said printing pass being a right to left sweep.

12. The method according to claim 1, further comprising:

performing a spitting operation of said printhead in said main spittoon in response to said bi-directional sweep time exceeding said decap time; and performing a bi-directional printing pass with said printhead.

13. The method according to claim 11, further comprising:

determining whether a sum of a current time and the bi-directional sweep time minus a last time a spit on the fly was performed is greater than or equal to said decap time in response to said bi-directional sweep time being less than said decap time;

performing a spitting operation of said printhead in said main spittoon in response to said bi-directional sweep time minus a last time a spit on the fly was performed being greater than or equal to said decap time; and performing a bi-directional printing pass with said printhead.

14. The method according to claim 1, further comprising:

performing a control spitting operation in one of said main spittoon and said auxiliary spittoon at a predetermined time during a printing operation, wherein said control spitting operation is performed in the main spittoon or the auxiliary spittoon based upon the spittoon the printhead is nearer at the predetermined time.

15. An apparatus for operating a printer having a main spittoon, an auxiliary spittoon, and a printhead, said printhead being operable to perform a uni-directional or bi-directional printing pass, said apparatus comprising:

a controller configured to receive a selected printmode and determine a decap time in response to said received printmode;

said controller further configured to estimate a nominal time to complete a uni-directional sweep and a bi-directional sweep; and said controller further configured to determine a last time said printhead was refreshed.

16. The apparatus according to claim 15, wherein said controller is further configured to determine whether said printing pass is a left to right sweep in response to said printmode being bi-directional.

17. The apparatus according to claim 16, wherein said controller is further configured to determine whether a uni-directional sweep time exceeds said decap time in response to said printing pass being a left to right sweep.

18. The apparatus according to claim 17, wherein said controller is further configured to determine whether a sum of a current time and the uni-directional sweep time minus a last time a spit on the fly was performed is greater than or equal to said decap time.

19. The apparatus according to claim 17, wherein said controller is further configured to determine whether a pass width of said printing pass is greater than or equal to a predetermined minimum pass width threshold in response to said sum of said current time and the uni-directional sweep time minus said last time a spit on the fly was performed being greater than or equal to said decap time.

20. The apparatus according to claim 19, wherein said controller is further configured to control the printhead to perform a spitting operation in said auxiliary spittoon in response to said pass width of said printing pass being greater than or equaling said minimum pass width threshold and to perform a bi-directional printing pass with said printhead.

21. A method for managing an auxiliary spittoon in a printer having a main spittoon and a printhead, said printhead being operable to perform a uni-directional or bi-directional printing pass, said method comprising:

receiving a selected printmode;

determining a decap time in response to said received printmode;

estimating a nominal time to complete a uni-directional sweep and a bi-directional sweep;

determining a last time said printhead was refreshed;

determining whether said printing pass is a left to right sweep in response to said printmode being bi-directional;

determining whether a uni-directional sweep time exceeds said decap time in response to said printing pass being a left to right sweep;

performing a spitting operation of said printhead in said auxiliary spittoon in response to a sum of a current time and the uni-directional sweep time minus a last time a spit on the fly was performed being greater than or equal to said decap time; and performing a bi-directional printing pass with said printhead.

22. The method according to claim 21, wherein said step of determining a last time said printhead was refreshed comprises:

determining which nozzles of said printhead were utilized in firing ink onto each cell of a prior printing pass;

determining a total amount of ink fired into each said cell by said utilized nozzles;

approximating an amount of ink fired by each of said utilized nozzles based on said total amount of ink fired into each cell;

detecting a time and cell in which the number of utilized nozzles is equal to or exceeds a predetermined threshold percentage of total nozzles in said printhead and in which the amount of ink fired into said cell is equal to or exceeds a predetermined threshold amount of ink; and setting said last time said printhead was refreshed in accordance with said detected time and cell.

23. The method according to claim 21, further comprising:

determining whether a pass width of said printing pass is greater than or equal to a predetermined minimum pass width threshold prior to performing said spitting operation.

24. The method according to claim 23, further comprising:

performing said spitting operation of said printhead in said auxiliary spittoon in response to said pass width of said printing pass being greater than or equaling said minimum pass width threshold; and omitting said spitting operation in response to said pass width of said printing pass being less than said minimum pass width threshold.

25. The method according to claim 21, further comprising:

performing a control spitting operation in one of said main spittoon and said auxiliary spittoon at a predetermined time during a printing operation, wherein said control spitting operation is performed in the main spittoon or the auxiliary spittoon based upon the spittoon the printhead is nearer at the predetermined time.

26. A computer readable storage medium on which is embedded one or more computer programs, said one or more computer programs implementing a method for operating a printer having a main spittoon, an auxiliary spittoon, and a printhead, said printhead being operable to perform a uni-directional or bi-directional printing pass, said one or more computer programs comprising a set of instructions for:

receiving a selected printmode;

determining a decap time in response to said received printmode;

estimating a nominal time to complete a uni-directional sweep and a bi-directional sweep;

determining a last time said printhead was refreshed;

determining whether said printing pass is a left to right sweep in response to said printmode being bi-directional;

determining whether a uni-directional sweep time exceeds said decap time in response to said printing pass being a left to right sweep;

performing a spitting operation of said printhead in said auxiliary spittoon in response to a sum of a current time and the uni-directional sweep time minus a last time a spit on the fly was performed is greater than or equal to said decap time; and performing a bi-directional printing pass with said printhead.

27. The computer readable storage medium according to claim 26, said one or more computer programs further comprising a set of instructions for:

determining which nozzles of said printhead were utilized in firing ink onto each cell of a prior printing pass;

determining a total amount of ink fired into each said cell by said utilized nozzles;

approximating an amount of ink fired by each of said utilized nozzles based on said total amount of ink fired into each cell;

detecting a time and cell in which the number of utilized nozzles is equal to or exceeds a predetermined threshold percentage of total nozzles in said printhead and in which the amount of ink fired into said cell is equal to or exceeds a predetermined threshold amount of ink; and setting said last time said printhead was refreshed in accordance with said detected time and cell.

28. The computer readable storage medium according to claim 26, said one or more computer programs further comprising a set of instructions for:

determining whether a pass width of said printing pass is greater than or equal to a predetermined minimum pass width threshold prior to performing said spitting operation.

29. The computer readable storage medium according to claim 28, said one or more computer programs further comprising a set of instructions for:

performing said spitting operation of said printhead in said auxiliary spittoon in response to said pass width of said printing pass being greater than or equaling said minimum pass width threshold; and omitting said spitting operation in response to said pass width of said printing pass being less than said minimum pass width threshold.

30. The computer readable storage medium according to claim 26, said one or more computer programs further comprising a set of instructions for:

performing a control spitting operation in one of said main spittoon and said auxiliary spittoon at a predetermined time during a printing operation, wherein said control spitting operation is performed in the main spittoon or the auxiliary spittoon based upon the spittoon the printhead is nearer at the predetermined time.

* * * * *